United States Patent [19]

Walker et al.

[11] 3,952,525

[45] Apr. 27, 1976

[54] MINE ROOF SUPPORT

[75] Inventors: John Hirst Walker; Dennis Franklin Rutherford; James Anthony Sutton, all of Cheltenham, England

[73] Assignee: Dowty Mining Equipment Limited, Tewkesbury, England

[22] Filed: Oct. 11, 1974

[21] Appl. No.: 514,261

[30] Foreign Application Priority Data

Oct. 18, 1973 United Kingdom ..... 48620/73
July 20, 1974 United Kingdom ..... 32251/74

[52] U.S. Cl. ..... 61/45 D
[51] Int. Cl.[2] ..... E21D 15/52
[58] Field of Search ..... 61/45 D; 299/33; 198/126

[56] References Cited

UNITED STATES PATENTS 3,084,920 4/1963 Barrett ..... 61/45 D

FOREIGN PATENTS OR APPLICATIONS 1,273,466 7/1968 Germany ..... 61/45 D

*Primary Examiner*—Jacob Shapiro
*Attorney, Agent, or Firm*—Young & Thompson

[57] ABSTRACT

A mine roof support arranged for propulsion over a mine floor by means of an advancing jack wherein the advancing jack is arranged to exert an inclined force on the support of which one component is parallel to the floor for propelling the support along the floor and the other component lifts or tends to lift the support from the floor thereby reducing frictional engagement with the floor.

19 Claims, 7 Drawing Figures

MINE ROOF SUPPORT

Figure 2:
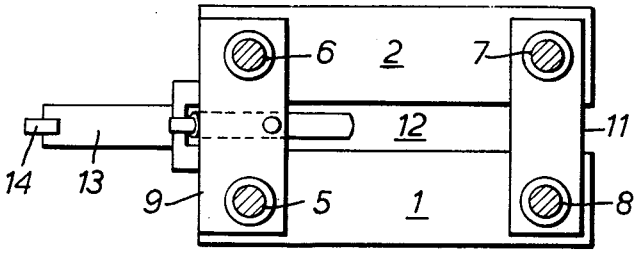

This invention relates to a mine roof support having an advancing jack arrangement interconnecting it with an anchorage whereby the jack arrangement may propel the support over the mine floor relatively to the anchorage. More usually the jack arrangement is such as to pull the support over the floor towards the anchorage. Resistance to such movement of the support is principally frictional engagement of the support with the mine floor. The object of this invention is to provide a jack arrangement capable of reducing the frictional engagement of the support with the floor.

The present invention comprises a roof support connectible to an anchorage by means of an advancing jack to propel the support over the mine floor when the support is released from the roof wherein the advancing jack is arranged to exert on the support an inclined force having one component parallel to the direction of propulsion along the floor and another component which lifts or tends to lift the support from the floor.

The support may have a relay bar connectible to the anchorage, a first pivotal joint on the support and a second pivotal joint secured to the relay bar, one pivotal joint being closer to the mine floor than the other pivotal joint the advancing jack being connected between the two pivotal joints and the relay bar being capable of directly reacting against the floor independently of the support for exerting the said inclined force.

The advancing jack may extend from the first pivotal joint rearwardly to the second pivotal joint having regard to the direction of propulsion of the support over the floor.

The support may include a floor beam having a central gap into which the relay link extends from the anchorage, the second pivotal joint and the jack being located at least partly in the gap.

Where the propulsion of the support is towards the anchorage the first pivotal joint may be located at the forward end of the support having regard to its propulsion whereby the upward component of the jack force is applied to the forward end of the support.

The second pivotal joint may be offset from the centre line of the advancing jack.

The jack may comprise a cylinder, a piston therein and a piston rod extending through one end of the cylinder, the other end of the cylinder being closed to define the main hydraulic working space and the second pivotal joint may be adjacent to the said one end of the cylinder. Thus pressure applied in the main hydraulic working space when the support is released from the roof will exert a force propelling the support over the floor towards the anchorage, the second pivotal joint being maintained substantially against movement by virtue of its connection through the relay bar to the anchorage.

The jack may include a seal at the said one end to engage between the cylinder and the piston rod to define a second working space within which liquid at pressure may act when the support is engaged with the roof to propel the anchorage away from the support.

Resilient means may be associated with the support to restrict angular movement of the jack about the first pivotal joint. The advancing jack may be located within a pair of telescopic tubes to resist bending moments if a pivotal joint is offset from the central axis of the jack.

Figure 1:
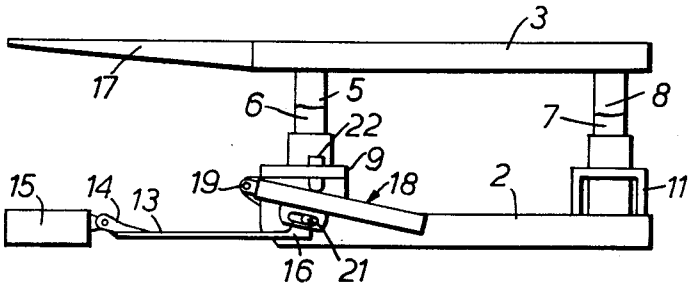
Figure 3:
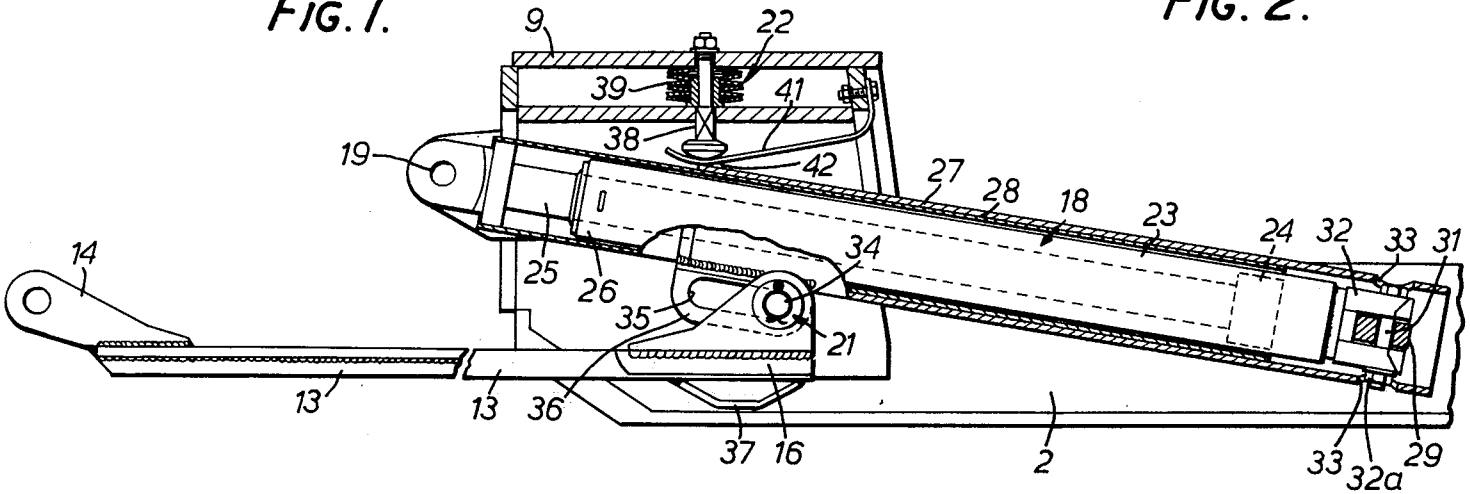
Figure 4:
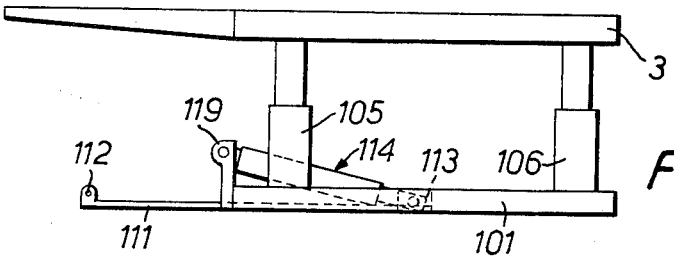
Figure 5:
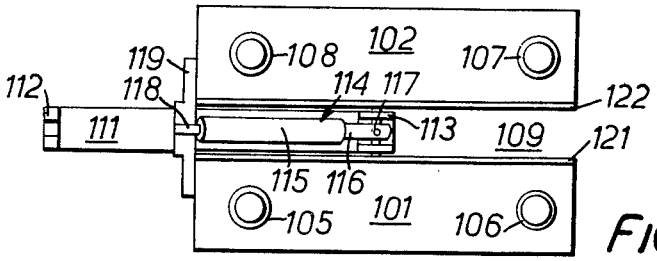
Figure 6:
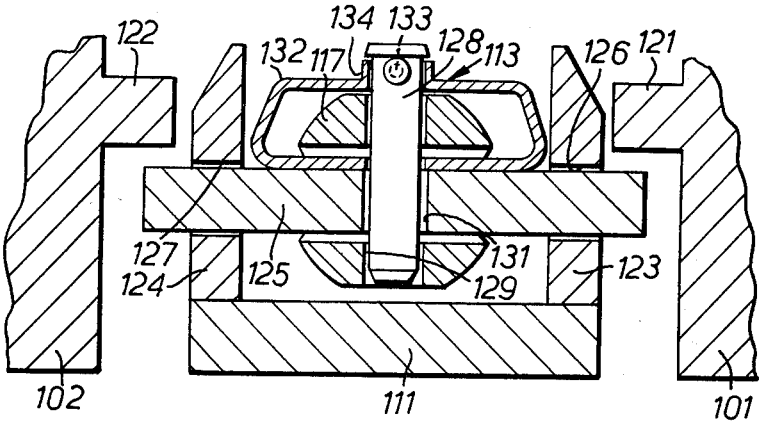
Figure 7:
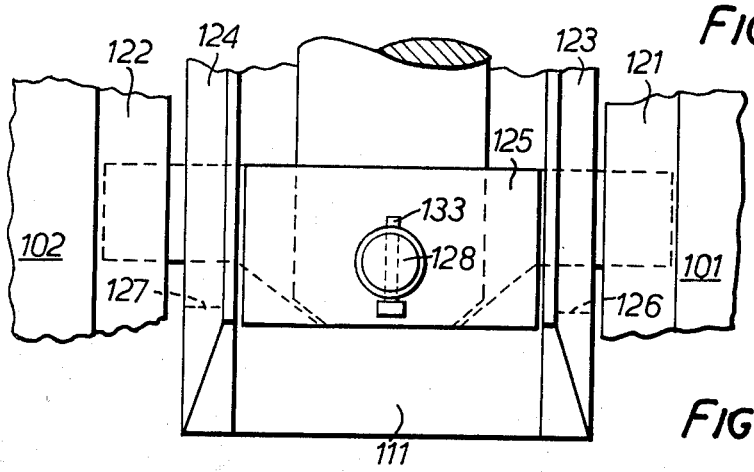

Two embodiments of the invention will now be described with reference to the accompanying drawings, in which:

FIG. 1 is a diagrammatic side elevation of the first embodiment of the invention, FIG. 2 is a diagrammatic plan view of the floor engaging member appearing in FIG. 1, FIG. 3 is a cross-section through the advancing jack assembly of FIGS. 1 and 2 showing in detail the two pivotal joints, FIG. 4 is a diagrammatic side elevation of the second embodiment of the invention, FIG. 5 is a diagrammatic plan view of the floor engaging member of the support shown in FIG. 4, FIG. 6 is a cross-section through the relay bar and associated floor beams of FIGS. 4 and 5, and FIG. 7 is a detailed view of the relay bar of FIG. 6.

Referring initially to FIGS. 1 and 2, the roof support diagrammatically illustrated comprises a pair of floor engaging beams 1 and 2, a roof engaging canopy 3 and four hydraulic jacks 5, 6, 7 and 8 extending between the floor beams and the canopy. The two floor beams 1 and 2 are secured together by a pair of bridge members 9 and 11 at the front and rear ends thereof to maintain the floor beams in parallel relation with a gap 12 between them forming a guide channel. A relay bar 13 is secured at its outer end by a conventional lug 14 to the armoured face conveyor 15 which effectively forms the anchorage for advancing the support. The relay bar 13 extends from lug 14 over the floor and into the gap 12, terminating at end portion 16. The roof bar 3 includes a cantilever extension 17 extending forwardly over the conveyor 15. For use a number of such supports are arranged in line along a mineral working face in a mine, the cantilever bars 17 being directed towards the mineral face. The conveyor 15 has limited flexibility and is capable of being pushed towards the new mineral face as mineral is excavated from the face, the relay links 13 being capable of providing a pushing force for this purpose.

The means for exerting either the conveyor pushing force or the conveyor advancing force comprises a double-acting hydraulic jack 18. The forward end of the jack 18 is secured at a pivotal joint 19 on the bridge structure 9. The jack 18 is also secured to the second pivotal joint 21 formed on the relay bar end portion 16. The first pivotal joint 19 is located at a greater distance from the floor than the second pivotal joint 21, thus requiring that any force exerted between these pivotal joints by the jack 18 must be in a line joining the two pivotal joints.

The jack 18 is retained in its operative position by means of the two pivotal joints 19 and 21 and a spring loading device 22 which reacts downwardly on the jack 18 from the bridge 9. The principal function of the device 16 is to resist the tendency of the jack 18 to lift during the application of thrust by the jack to the relay link 13 to advance the conveyor towards the mineral face.

Reference is now made to FIG. 3 for discussion of the structural details of the jack. The jack 18 comprises a double-acting jack having a cylinder 23, a piston 24 slidable within the cylinder and a piston rod 25 slidable within the cylinder through a sealed end portion 26. The opposite end of the cylinder is closed. The piston rod 25 at its end opposite to the piston is secured to the first pivotal connection 19. Hydraulic connections to the jack may be made in the conventional way by passages (not shown) extending from the pivotal joint 19 through the piston rod 25 to the two sides of the piston 24.

The jack 18 is enclosed within a pair of telescopic tubular guides 27 and 28 to resist bending moment and to protect the jack. The tube 28 is securely fixed to the outer end of the piston rod 25 and extends with clearance over the cylinder 23. The tube 27 is a good sliding fit on the tube 28 and is secured to the cylinder 23 by means of a bar 29 extending transversely across one end of the tube 27 and engaged by a bolt 31 in a bifurcated lug 32 attached to the closed end of the cylinder 23. Access for securing the bolt 31 and its locking nut 32 is by means of a pair of holes 33 formed at diametrically opposite positions in the tube 27.

The second pivotal joint 21 is formed by a pivot pin 34 which extends through a slot 35 in a bracket 36 fixedly secured to the end of the tube 27 remote from the bar 29. The pin 34 is carried by a bifurcated extension of the end portion 16 and the slot 31 will enable a predetermined degree of lost motion of the bar 13 relative to the jack 18. The relay bar end portion 16 is provided with a floor engaging extension 37.

The spring loading device 22 comprises a plunger 38 slidably supported for vertical movement in the bridge member 9 and capable of being urged downwardly by a Belleville washer spring 39. The lower end of plunger 38 engages a spring steel strip 41 secured to the bridge member 9, the strip 41 having a curved end 42 for engagement with the tubular guides 27 and 28. The device 22 is so arranged that it will exert a downward force on the tubes 27 and 28 only when the jack assembly 18 rises slightly from the position shown in FIG. 3.

When it is necessary to supply advancing force to the conveyor, hydraulic liquid at pressure is supplied into the cylinder 23 in the second working space located between the piston rod 25, the piston 24 and the cylinder 23 so that the pressure will act over a small area of piston 17 to move the cylinder towards the first pivotal joint 19. The movement of the cylinder is transmitted through bar 29, tube 27, bracket 36, pin 34 and relay bar 13. Since the pin 34 is offset from the centre line of the jack 18, the thrust exerted will also generate a bending moment within the tubes 27 and 28, the tubes being so designed that they can normally accept such bending moment. The force exerted by the jack will also tend to cause the pivotal joint 21 to lift so that it tends to intersect a straight line extending through the pivotal joints 14 and 19. Such upward movement however is resisted by engagement of the tubes 27 and 28 with the spring strip 41 which in turn will tend to compress the Belleville washer spring 39. The spring 39 is designed to resist such normal upward force and will tend to hold the free end of the tube 27 substantially in the gap 12.

In order to advance the support towards the conveyor, hydraulic liquid at pressure is supplied to the side of the piston 24 adjacent to the bifurcated end 32 to act in the main working space defined between the piston and the closed end of the cylinder. The pressure will act over the full area of the piston to urge it in the direction of the pivotal joint 19 and will react through cylinder 23, bar 29, tube 27, lug 36 and pivotal joint 21 to provide a tension force within the relay bar 13. The support is released from the roof but the conveyor 15 is held by adjacent supports. The piston 24 will then push the support towards the conveyor. During such movement, the pin 34 will engage the opposite end of slot 35 from that shown in FIG. 3. The thrust exerted by the jack 18 will act in a straight line between the pivotal joints 19 and 21. Due to the difference in height from the floor of the pivotal joints 19 and 21, this force will be inclined to the floor. At the pivotal joint 19, the horizontal component of this force will urge the support forwardly whilst the vertical component of the force will act against the weight of the support to tend to lift the support from the floor thus reducing frictional engagement. At the pivotal joint 21, the horizontal component of the force will be resisted by tension in the relay bar 13 and the vertical component will urge the extension 37 into direct engagement with the floor. Since the thrust exerted at the pivotal joint 21 is offset from the centre line of the jack 18, a bending moment will be generated within the tubes 27 and 28 which are of course designed to adequately resist such moment.

The slot 35 provides a lost motion connection between the jack 18 and the bar 13 and will ensure that after full advance of the support by the jack 21, and resetting of the support to the roof, slight movement of the conveyor towards the support during passage of a mineral mining machine along the conveyor will be accommodated within the lost motion and will avoid excessive compression load in the relay bar 13.

In the illustrated construction, the accumulation of rubble in the gap 12 will not effectively obstruct operation of the jack 18. If any such rubble tends to lift the free end of the tube 27 during support advance the downward reaction on the end portion 16 is in effect transferred to the free end of the tube 27 but the operation of the jack will remain the same.

Reference is now made to FIGS. 4 to 7 of the drawings. The roof support diagrammatically illustrated in FIG. 4 comprises a pair of floor engaging beams 101 and 102, a roof engaging canopy 103 and four hydraulic jacks 105, 106, 107 and 108 extending between the floor beams and the canopy. The hydraulic jacks 105, 106, 107 and 108 are controllable by conventional means either to urge the canopy 103 into engagement with the roof or to move the canopy 103 from engagement with the roof. The floor beams 101 and 102 are arranged in parallel relation leaving a gap 109 between them to form a guide channel. The beams are suitably secured together by bridge means (not shown). A relay bar 111 is secured at its outer end by a conventional lug 112 to the armoured face conveyor which effectively forms the anchorage for advancing the support. The relay bar extends from the lug 112 over the floor and into the gap 109, terminating within the gap 109 at end portion 113.

The hydraulic advancing jack 114 is of conventional construction comprising a cylinder 115 having a piston therein from which a piston rod 116 extends in a sealed manner through one end of the cylinder. The piston rod 116 terminates in a connecting lug 117 whilst at the opposite end the cylinder 115 is provided with a connecting lug 118. The lug 118 is pivotally connected to a bridge member 119 extending between the front edges of the floor beams 101 and 102. This is the first pivotal joint. The lug 117 is pivotally connected to the relay bar end portion 113 at the second pivotal joint. It will be seen that the bridge member 119 supports the lug 118 of the cylinder 115 at a distance from the floor substantially greater than the distance of the lug 117 from the floor, whereby the jack is inclined upwardly and forwardly from the second pivotal connection to the first pivotal connection. Within the jack there is formed in the conventional manner, a full area working space within which liquid may act over the full area of the piston and a second working space within which liquid may act on the annular area of the piston defined between the piston rod and the cylinder.

In order to advance the support towards the conveyor, the support is lowered from the roof by releasing hydraulic liquid from the four jacks, 105, 106, 107 and 108, then hydraulic pressure is supplied to the jack 114 to the main working space to cause the jack 114 to increase its length. The thrust exerted by the jack at the lug 118 may be resolved into a horizontal and a vertical component. The horizontal component urges the support forwardly over the floor whilst the vertical component acts upwardly on the floor beams removing some weight from the floor beams thus reducing the frictional engagement between the floor beams and the floor. At the end portion 113, the thrust of the jack provides a horizontal thrust component producing tension in the relay bar 111 and a vertically downward force component urging the relay bar end portion 113 into strong engagement with the floor. The tension force in the relay bar 111 is therefore the horizontal force which acts on the bridge 119 to urge the support forwardly. The vertically upward force exerted at the bridge member 119 will reduce the frictional engagement of the support with the floor thus enabling the support to be advanced with a smaller hydraulic effort from the jack 114. During advancing of the support, the end portion 113 is guided within the gap 109 between the floor beams ensuring that the support advances directly towards the anchoring lug 112 on the conveyor.

When it is required to advance the conveyor forwardly from the support, the support itself is raised so that the canopy 103 engages the roof strongly. Hydraulic pressure is then applied into the second working space of the jack 114 and the jack will tend to contract in length applying a force to the relay bar 111 urging the conveyor forwardly. A vertical reaction will be exerted on the end portion 113 urging it upwardly within the gap 1. To resist such upward movement, the end portion 113 is arranged to engage the pair of guide rails 121 and 122 secured to the inner edges of the floor beams 101 and 102.

Reference is now made to FIGS. 6 and 7 to show a preferred construction of the end portion 113 of the relay bar 111. Upstanding lugs 123 and 124 are provided one at each side and a cross member 125 extends through slots 126, 127 in the lugs 123 and 124 to provide means to engage the rails 121 and 122 extending from the floor beams 101 and 102. The lug 117 formed at the end of the connecting rod 116 if bifurcated and extends on either side of the cross member 125. A pin 12 extends through cooperating holes 129 and 131 in the lug 117 and in the cross member 131 to form the pivotal engagement between the piston rod 116 and the end portion 113.

In order to lock the pin 128 in its operative position, a flat sleeve 132 is fitted around one half of the lug 117, the sleeve being provided with suitable holes through which the pin 128 will pass. A locking pin 133 is then passed through the pin 128 and an annular extension 134 of the sleeve 132 so as to prevent the pin 128 from moving from its operative position, but at the same time allowing the pin to remain loose so as to provide for slight changes in angular position between the piston rod 116 and the relay bar 111 as the jack 114 extends or contracts. The sleeve also ensures that the cross member projects to substantially equal extents beyond the lugs 123 and 124 to engage both rails 121 and 122.

When the jack 114 contracts to exert a compression force on the relay bar 111, the transfer of this thrust passes from the lug 117 through pin 128, cross member 125 and side lugs 123 and 124 to the relay bar 111. When the jack extends to exert a tension force in the relay bar, the cross member moves to the opposite ends of slots 126 and 127 and also the base of the bifurcation in the connecting rod will engage the cross member directly. During extension of the jack 114 to advance the support, the end portion 111 will be urged downwardly to engage the floor in between the floor beams 101 and 102. During contraction of the jack 114 to advance the conveyor, the end portion 113 will rise upwardly to a slight extent between the floor beams and the ends of the cross member 125 will engage the rails 121 and 122.

If the relay bar is damaged and needs to be replaced, it is necessary to be able to lift the relay bar from between the floor beams. To lift the relay bar, pin 128 and sleeve 132 are removed and the bifurcated connecting rod is then removed from the cross member. The end 112 of the relay bar is disconnected from the conveyor. The cross member 125 is then moved to a diagonal position within slots 126 and 127 so that the ends of the cross member do not project from the lugs 123 and 124. The relay bar may then be lifted from between the floor beams. A new relay bar may then be inserted for use by the reverse of the above procedure.

The slots 126 and 127 provide a lost motion connection between the advancing jack 114 and the relay bar 111 and will ensure that after a full advance of the support and resetting of the support against the roof, slight movement of the conveyor due to passage of the coal plough along the conveyor is accommodated by the lost motion, thus avoiding excessive compression load in the relay bar.

In both embodiments of the invention, the advancing jack is provided with a main working space operative over the full area of the piston and the second working space operative only over an annular area of the piston. Advancing of the support over the floor requires a considerably greater force than advancing of the conveyor towards the coal face and the arrangement of the jack is such that hydraulic pressure in the main working space operates over the full area of the piston for advancing the support thus providing a substantial force, whilst for advancing the conveyor hydraulic liquid in the second working space operates only over an annular area of the piston to provide a smaller force. Thus it is possible for one source of liquid at pressure to supply the jack to effect both of these functions.

In the embodiment described with reference to FIGS. 1 to 3, the second pivotal connection 21 is shown offset from the centre line of the jack 18. It is within the scope of the present invention for the second pivotal connection to be on the centre line of the jack 18. The second pivotal connection may also be connected at any position along the length of the jack. The first pivotal connection may also be offset from the centre line of the jack.

In the embodiment illustrated in FIGS. 1 to 3, the jack 18 and its tubular guides are shown in an inclined position at the forward end of the support, whereby a substantial part of the jack is located in the gap 12 and the first pivotal connection 19 is located at a comparatively high position on the bridge 9. A line joining the pivotal connections 19 and 21 then has substantial inclination to the floor ensuring that initial movement of the jack 18 to advance the support would give a substantial upward force component capable of lifting the front edge of the floor beam of the support above any depression in the floor. Such depression could result from an excessive roof load previously acting on the support. As the jack 18 extends during advancing of the support, the inclination of the line joining the pivotal connections 19 and 21 will alter and will reduce the upward force component acting on the support. This, however, is no disadvantage since when the support is moving, the frictional force with the floor becomes smaller.

We claim:

1. A mine roof support intended to stand on a mine floor and having an advancing jack capable of advancing the support by extension of its length, a first pivotal joint on the support to which the advancing jack is secured, a second pivotal joint secured to the jack such that change of jack length will change the spacing between the pivotal joints, an anchorage connection secured to the second pivotal joint to locate the second pivotal joint closer to the floor than the first pivotal joint such that extension of the advancing jack to advance the support exerts on the first pivotal joint a force having one component parallel to the direction of advancing and another component which lifts, or tends to lift, the support from the floor.

2. A mine roof support as claimed in claim 1, wherein said anchorage connection comprises a relay bar, an anchorage, and a third pivotal joint by which the relay bar is secured to the anchorage, the second pivotal joint being secured to the relay bar at a position spaced from the third pivotal joint.

3. A mine roof support as claimed in claim 2 wherein the support includes a floor beam having a central gap into which the relay bar extends from the anchorage, the second pivotal joint and the jack being located at least partly within the gap.

4. A mine roof support as claimed in claim 1 and wherein the support includes a floor beam and the first pivotal joint is located at the forward end of the floor beam having regard to its advancing direction whereby the upward component of jack force is applied to the forward end of the support.

5. A mine roof support as claimed in claim 2 wherein the support includes a floor beam and the first pivotal joint is located at the forward end of the floor beam having regard to its advancing direction whereby the upward component of the jack force is applied to the forward end of the support.

6. A mine roof support as claimed in claim 1 wherein the second pivotal joint is offset from the centre line of the jack.

7. A mine roof support as claimed in claim 2 wherein the second pivotal joint is offset from the centre line of the jack.

8. A mine roof support as claimed in claim 5 wherein the second pivotal joint is offset from the centre line of the jack.

9. A mine roof support as claimed in claim 1 wherein the jack comprises a cylinder, a piston therein and a piston rod extending through one end of the cylinder, the other end of the cylinder being closed to form the main working space, and the second pivotal joint is adjacent the said one end of the cylinder.

10. A mine roof support as claimed in claim 1 wherein the jack comprises a cylinder, a piston therein and a piston rod extending through one end of the cylinder, the other end of the cylinder being closed to form the main working space, and the second pivotal joint is adjacent the said one end of the cylinder.

11. A mine roof support as claimed in claim 10 including a seal at the said one end of the jack to engage between the cylinder and the piston rod to provide a second working space within which liquid at pressure may act when the support is engaged with the roof to propel the anchorage relative to the support.

12. A mine roof support as claimed in claim 11 including resilient means associated with the support to restrict angular movement of the jack about the first pivotal joint.

13. A mine roof support as claimed in claim 6 including a pair of telescoping tubes enclosing the jack to resist bending moment due to the offset of the second pivotal joint.

14. A mine roof support as claimed in claim 7 wherein the jack is inclined relative to the relay bar.

15. A mine roof support as claimed in claim 6, wherein the jack comprises a cylinder, a piston therein and a piston rod extending through one end of the cylinder, the other end of the cylinder being closed to form the main working space, and the pivotal joint is adjacent the said one end of the cylinder.

16. A mine roof support as claimed in claim 7, wherein the jack comprises a cylinder, a piston therein and a piston rod extending through one end of the cylinder, the other end of the cylinder being closed to form the main working space, and the second pivotal joint is adjacent the said one end of the cylinder.

17. A mine roof support as claimed in claim 8, wherein the jack comprises a cylinder, a piston therein and a piston rod extending through one end of the cylinder, the other end of the cylinder being closed to form the main working space, and the second pivotal joint is adjacent the said one end of the cylinder.

18. A mine roof support intended to stand on a mine floor and having an advancing jack capable of advancing the support by changing its length, a first pivotal joint on the support to which the advancing jack is secured, a second pivotal joint secured to the jack such that change of length of the jack will vary the spacing between the pivotal joints, and an anchorage to which the second pivotal joint is secured, the first and second pivotal joints being located at different heights relative to the mine floor such that change in length of the advancing jack to advance the support relative to the anchorage exerts an inclined force on the support having one component parallel to the advancing direction of the support over the mine floor and another component which lifts, or tends to lift, the support from the floor.

19. A mine roof support as claimed in claim 18, wherein the support includes a floor beam and the first pivotal joint is secured to the forward end portion of the floor beam having regard to its advancing direction.

* * * * *